US006419337B2

(12) United States Patent
Sayama

(10) Patent No.: US 6,419,337 B2
(45) Date of Patent: Jul. 16, 2002

(54) INK JET RECORDING APPARATUS AND METHOD OF DRIVING THE SAME

(75) Inventor: Tomohiro Sayama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/910,944

(22) Filed: Jul. 24, 2001

(30) Foreign Application Priority Data

Jul. 24, 2000 (JP) ..... 2000-222177
Jul. 4, 2001 (JP) ..... 2000-202979

(51) Int. Cl.[7] ..... B41J 29/38

(52) U.S. Cl. ..... 347/11; 347/9; 347/10

(58) Field of Search ..... 347/9, 10, 11

(56) References Cited

FOREIGN PATENT DOCUMENTS

JP 10081014 A * 3/1998 ..... B41J/2/045

* cited by examiner

*Primary Examiner*—John Barlow
*Assistant Examiner*—Alfred Dudding
(74) *Attorney, Agent, or Firm*—Sughrue Mion, PLLC

(57) ABSTRACT

A drive signal generator generates a series of drive signals, each including at least three primary ejecting pulses generated at a first cycle in a unit recording period and at least one auxiliary ejecting pulse generated after a time period which is a half of the first cycle is elapsed since one of the primary ejecting pulse is generated. The primary ejecting pulses and the auxiliary ejecting pulse have an identical waveform. A pulse supplier selectively applies at least one of the primary ejecting pulses and the auxiliary pulse from the drive signal to a pressure generating element such that time intervals of the supplied pulses are made constant over adjacent unit recording periods when dots having the same size are successively recorded.

12 Claims, 12 Drawing Sheets

| GRADATION LEVEL | FIRST PULSE | SECOND PULSE | THIRD PULSE | FOURTH PULSE | DECODED VALUE | DOT SIZE |
|---|---|---|---|---|---|---|
| 1 (00) | × | × | × | × | (0000) | - |
| 2 (01) | × | × | ○ | × | (0010) | SMALL |
| 3 (10) | × | ○ | × | ○ | (0101) | MEDIUM |
| 4 (11) | ○ | × | ○ | ○ | (1011) | LARGE |

INK JET RECORDING APPARATUS AND METHOD OF DRIVING THE SAME

BACKGROUND OF THE INVENTION

The present invention relates to an ink jet recording apparatus for ejecting an ink drop from a nozzle orifice by causing pressure fluctuation in a pressure chamber to record an image, and relates to a method of driving the apparatus.

In an ink jet recording apparatus such as an ink jet printer or a plotter, an ink drop is ejected from a nozzle orifice of a recording head, thereby recording an image or a character on recording paper. More specifically, the recording head is moved in a main scanning direction and the recording paper is moved in a subscanning direction. The ink drop is ejected by operating a pressure generating element (for example, a piezoelectric vibrator) provided in association with the nozzle orifice and causing pressure fluctuation in a pressure chamber communicating with the nozzle orifice.

In this related recording apparatus, gradation recording is carried out with plural kinds of dots having various sizes in order to enhance an image quality. For this reason, there has been proposed a recording apparatus for changing the size of a dot according to the number of ejecting pulses to be supplied to a pressure generating element. In the recording apparatus, a drive signals in which a plurality of ejecting pulses having the same shape for electing an ink drop are arranged in series is generated, and at least one of the pulse signals is selectively supplied to the pressure generating element from the drive signal.

For example, a drive signal includes three ejecting pulses generated at constant intervals within a unit recording period. In a case where a large dot is to be formed, all the three ejecting pulses are supplied to the pressure generating element in a case where a medium dot is to be formed, two ejecting pulses are supplied to the pressure generating element. In a case where a small dot is to be formed, one ejecting pulse is supplied to the pressure generating element. Consequently, the recording is carried out in four gradations of "large dot", "medium dot", "small dot" and "non-recording".

In the related recording apparatus, thus, the pressure fluctuation is generated on ink in the pressure chamber to eject an ink drop. Accordingly, it is important that conditions for ejecting each ink drop are coincident with each other to record a high quality image consist of dots having identical sizes.

There will be considered a case where an ejecting pulse is generated in a cycle of 50 microseconds and three ejecting pulses are included in a unit recording period. In this case, when a large dot is to be recorded, all the three ejecting pulses in the recording period are selected. When a medium dot is to be recorded, two ejecting pulses, for example, a first ejecting pulse and a third ejecting pulse are selected. Moreover, when a small dot is to be recorded, one ejecting pulse, for example, a second ejecting pulse is selected.

In a case where the large dot is to be recorded successively, all the ejecting pulses generated in the cycle of 50 microseconds are selected and are supplied to the pressure generating element. Therefore, an interval at which the ejecting pulse is supplied becomes constant to be 50 microseconds. Similarly, when the small dot is to be recorded successively, a specific ejecting pulse is selected to be supplied to the pressure generating element. For this reason, the interval at which the ejecting pulse is supplied becomes constant to be 150 microseconds. Referring to the large dot and the small dot, accordingly, the amount of the ink drop can be equal also during the successive recording operation.

In a case where a medium dot is to be recorded successively, however, two of the three ejecting pulses generated at constant intervals in a unit recording period are selected. Therefore, the interval at which the ejecting pulse is supplied is not constant with a variation of 50 microseconds, 100 microseconds, 50 microseconds, 100 microseconds, . . . and vice versa.

Due to such a variation in the supply interval, the ink drop is ejected unstably. For example, flight deviation of ink drop is occurred or the amount of the ink drop is varied. It is supposed that such a situation occurs because the pressure fluctuation in the pressure chamber becomes unstable with variation in the supply interval. When the ink drop is ejected unstably, there is a drawback that an image has uneven gradations.

SUMMARY OF THE INVENTION

The invention has been made in consideration of such circumstances and has an object to provide an ink jet recording apparatus capable of preventing a drawback such as uneven gradations in a recorded image and to provide a method of driving the apparatus.

In order to achieve the above object, according to the present invention, there is provided an ink jet recording apparatus, comprising:

an ink jet recording head, including a nozzle orifice, a pressure chamber communicated with the nozzle orifice, and a pressure generating element which generates pressure fluctuation in ink stored in the pressure chamber to eject an ink drop from the nozzle orifice;

a drive signal generator, which generates a series of drive signals, each drive signal including at least three primary ejecting pulses generated at a first cycle in a unit recording period and at least one auxiliary ejecting pulse generated after a time period which is a half of the first cycle is elapsed since one of the primary ejecting pulse is generated, the primary ejecting pulses and the auxiliary ejecting pulse having an identical waveform; and a pulse supplier, which selectively applies at least one of the primary ejecting pulses and the auxiliary pulse from the drive signal to the pressure generating element so that the number of ink drop ejected in the unit recording period is changed in accordance with a size of dot to be recorded, the pulse supplier selecting supplied pulse such that time intervals of the supplied pulses are made constant over adjacent unit recording periods when dots having the same size are successively recorded.

In this configuration, the state of meniscus of ink at a time when each ejecting pulse is started to be supplied cam be made equal so that the ejecting conditions of the ink drop is fixed. Thereby, variation in the ejection amount, the flight speed and the flight direction of the ink drop can be prevented. As a result it is possible to prevent a recorded image from being uneven, thereby enhancing the recorded image quality.

Preferably, three primary ejecting pulses and an auxiliary ejecting pulse are included in each drive signal. Here, the pulse supplier selects the three primary ejecting pulses from the drive signal when a dot having a first size is recorded. The pulse supplier selects one of the primary ejecting pulses and the auxiliary ejecting pulse from the drive signal when a dot having a second size which is smaller than the first size is recorded.

Here, it is preferable that the pulse supplier selects one of the primary ejecting pulses which is secondary generated when a dot having a third size which is smaller than the second size is recorded. And the primary ejecting pulse selected when the second size of dot is recorded is a primary ejecting pulse placed in opposite side of the secondary generated primary ejecting pulse with respect to the auxiliary ejecting pulse.

Further, It is preferable that a timing which is a half of the unit recording period comes while a primary ejecting pulse appeared secondary is generated.

Preferably, the drive signal includes a vibrating pulse which is selectively applied to the pressure generating element by the pulse supplier for vibrating meniscus of ink in the nozzle orifice such an extent that an ink drop is not ejected therefrom. Here, the vibrating pulse is generated between at least one pair of the adjacent primary ejecting pulses at which no auxiliary ejecting pulse is generated.

Preferably, the pressure generating element is a piezoelectric vibrator which varies a volume of the pressure chamber.

Alternatively, it is preferable that the pressure generating chamber is a heating element which varies a volume of an air bubble generated in ink stored in the pressure chamber with heat.

According to the present invention, there is also provided a method of driving an ink jet recording apparatus provided with an ink jet recording head, inducting a nozzle orifice, a pressure chamber communicated with the nozzle orifice, and a pressure generating element the method comprising the steps of:

generating a series of drive signals, each drive signal including at least three primary ejecting pulses generated at a first cycle in a unit recording period and at least one auxiliary ejecting pulse generated after a time period which is a half of the first cycle is elapsed since one of the primary ejecting pulse is generated, the primary ejecting pulses and the auxiliary ejecting pulse having an identical waveform;

selecting at least one of the primary ejecting pulses and the auxiliary pulse from the drive signal such that the number of ink drop ejected in the unit recording period is changed in accordance with a size of dot to be recorded, and such that time intervals of the supplied pulses are made constant over adjacent unit recording periods with respect to all recordable gradation levels; and applying the selected ejecting pulse to the pressure generating element to generate pressure fluctuation in ink stored in the pressure chamber to eject an ink drop from the nozzle orifice.

Preferably, three primary ejecting pulses and an auxiliary ejecting pulse are included in each drive signal so that a first gradation level realized by a dot having a first size, a second gradation level realized by a dot having a second size which is smaller than the first size, and a third gradation level realized by a dot having a third size which is smaller than the second size are made recordable. Here, the three primary ejecting pulses are selected from the drive signal when the first gradation level is recorded. One of the primary ejecting pulses and the auxiliary ejecting pulse are selected from the drive signal when the second gradation level is recorded. One of the primary ejecting pulses is selected from the drive signal when the third gradation level is recorded.

Here, it is preferable that the primary ejecting pulse selected when the third gradation level is recorded is a primary ejecting pulses which is secondary generated. And it is preferable that the primary ejecting pulse selected when the second gradation level is recorded is a primary ejecting pulse placed in opposite side of the secondary generated primary ejecting pulse with respect to the auxiliary ejecting pulse.

Preferably, the pressure fluctuation is generated by varying a volume of the pressure chamber through use of a piezoelectric vibrator as the pressure generating element.

Alternatively, it is preferable that the pressure fluctuation is generated by varying a volume of an air bubble generated in ink stored in the pressure chamber with heat generated from a heating element provided as the pressure generating element.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Figure 1:
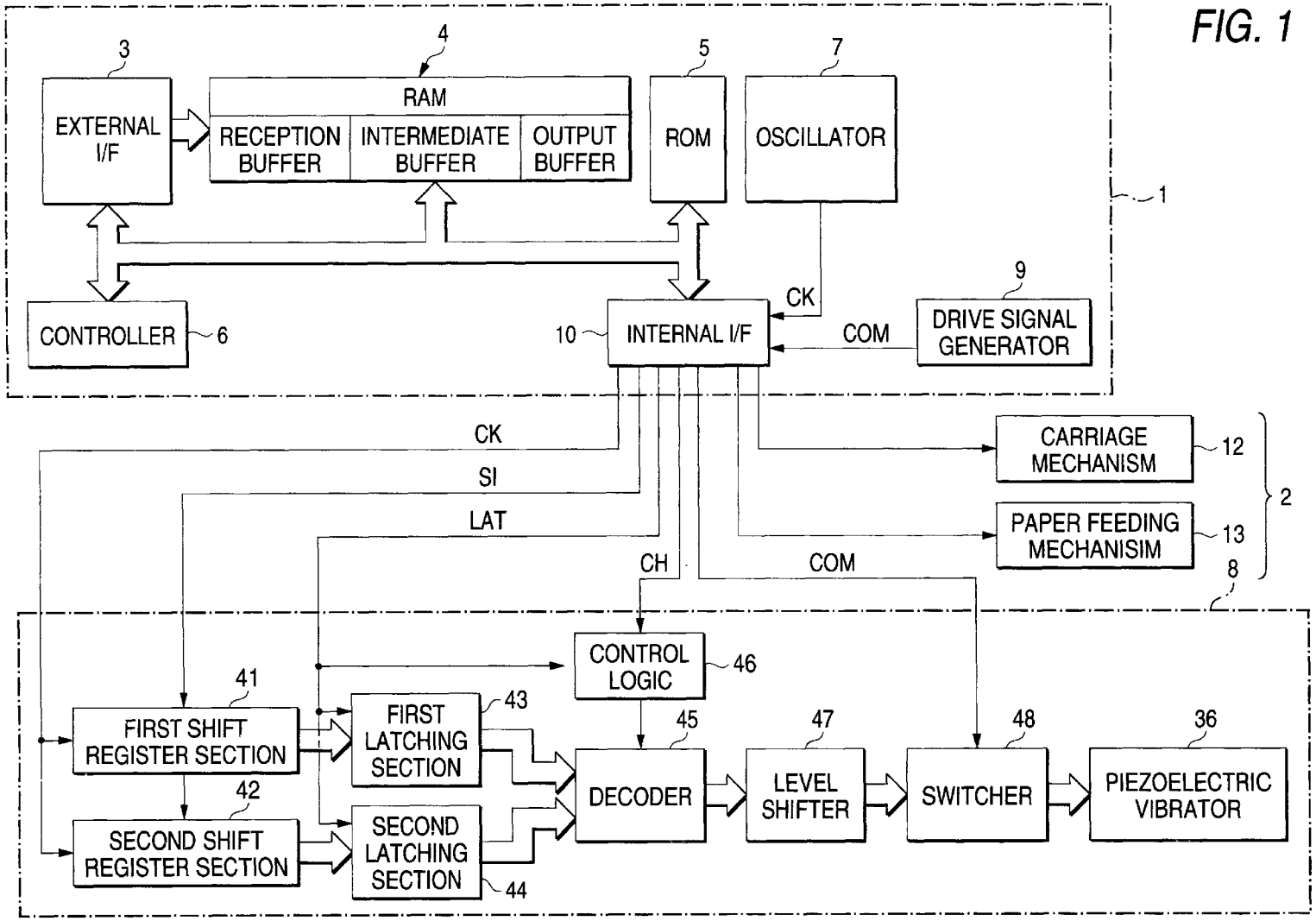
FIG. 1 is a diagram illustrating the whole structure of an ink jet recording apparatus.

Embodiments of the invention will be described below with reference to the accompanying drawings. FIG. 1 is a block diagram showing an ink jet printer (which will be hereinafter referred to as a printer) provided as an ink jet recording apparatus.

The illustrated ink jet printer is constituted by a printer controller 1 and a print engine 2. The printer controller 1 comprises an interface 3 (which will be hereinafter referred to as an external I/F 3) for receiving print data from a host computer which is not shown, a RAM 4 for storing various data, a ROM 5 for storing a routine for processing various data, a controller 6 including a CPU, an oscillator 7 for generating a dock signal (CK), a drive signal generator 9 for generating a drive signal (COM) to be supplied to a recording head 8, and an interface 10 (which will be hereinafter referred to as an internal I/F 10) for transmitting dot pattern data and the drive signal to the print engine 2.

The external I/F 3 receives, from the host computer, print data including one or more data of a character code, a graphic function and image data. Moreover, the external I/F 3 outputs a busy signal (BUSY) or an acknowledge signal (ACK) to the host computer.

The RAM 4 is utilized as a reception buffer, an intermediate buffer, an output buffer and a work memory (not shown). The reception buffer temporarily stores the print data received by the external I/F 3 from the host computer. The intermediate buffer stores an intermediate code. In output buffer, the intermediate code is converted into gradation data for each dot, that is, dot pattern data. The ROM 5 stores various control routines to be executed by the controller 6, font data and a graphic function, and various procedures.

The controller 6 reads the print data in the reception buffer and convert the same data into an intermediate code, and stores the intermediate code in the intermediate buffer. Moreover, the controller 6 analyzes the intermediate code read from the intermediate buffer and converts the intermediate code into the gradation data for each dot by referring to the font data and the graphic function in the ROM 5. The gradation data (SI) are constituted by 2-bit data, for example.

Figure 5:
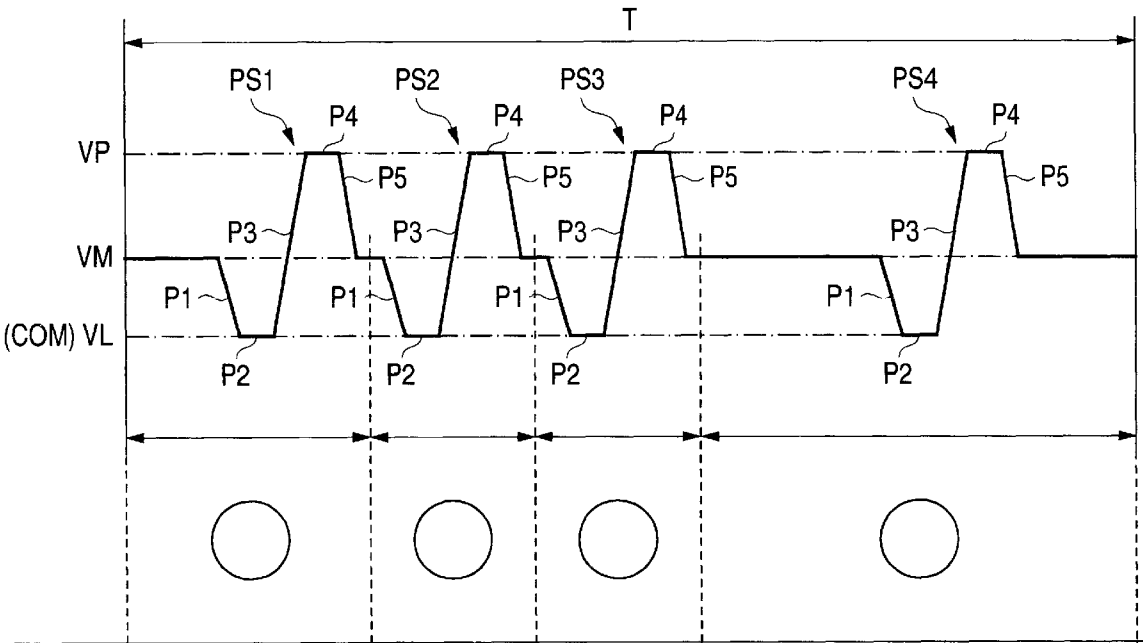
FIG. 5 is a chart illustrating a relationship between the drive signal and a gradation level.
Figure 6:
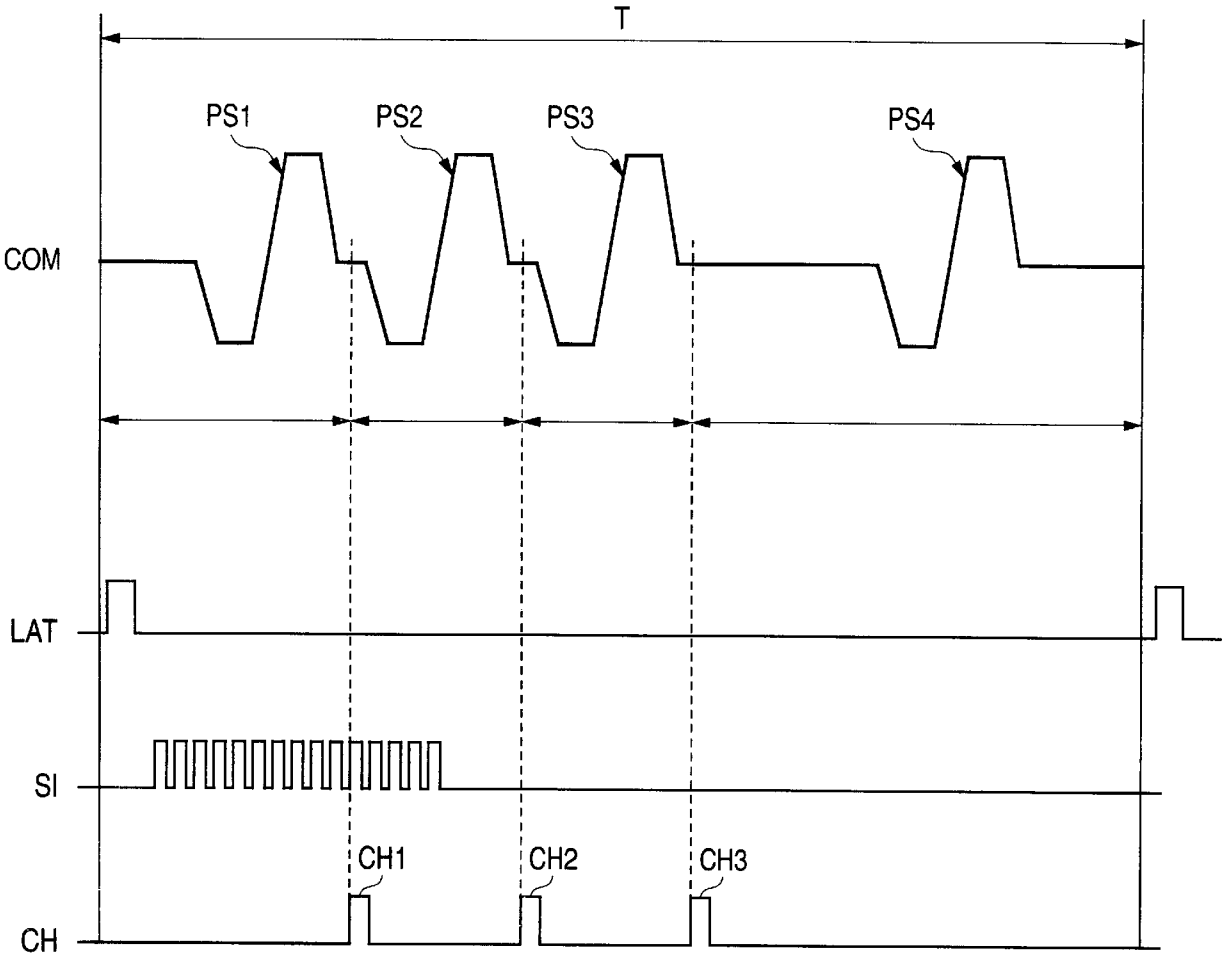
FIG. 6 is a time chart showing a relationship between each drive pulse of the drive signal and a transfer timing of gradation data.

The gradation data represent four gradations. More specifically, as shown in FIG. 5, gradation data (00) are a gradation referred to as a gradation level 1 corresponding to "non-recording" in which a dot is not recorded. Gradation data (01) are a gradation referred to as a gradation level 2 in which a small dot is recorded. Gradation data (10) are a gradation referred to as a gradation level 3 in which a medium dot is recorded. Gradation data (11) are a gradation referred to as a gradation level 4 in which a large dot is recorded.

The gradation level 4 is referred to also as a first gradation level in the invention, the gradation level 3 is referred to also as a second gradation level in the invention, and the gradation level 2 is referred to also as a third gradation level in the invention.

The gradation data converted by the controller 6 is stored in the output buffer, and gradation data corresponding to one line of the recording head 8 are obtained and are then serially transmitted to the recording head 8 through the internal I/F 10. When the gradation data for one line are outputted from the output buffer, the contents of the intermediate buffer are erased and conversion for next intermediate code is carded out. Moreover, the controller 6 constitutes a part of timing signal generator and supplies a latch signal (LAT) and a channel signal (CH) to the recording head 8 through the internal I/F 10. The latch signal and the channel signal define a supply start timing of pulse signals (a first pulse PS1 to a fourth pulse PS4) constituting the drive signal (COM).

The drive signal generator 9 generates a series of drive signals each including a plurality of ejecting pulses for ejecting a predetermined amount of ink drops from a nozzle orifice 11 (see FIG. 2) of the recording head 8 and is constituted by primary ejecting pulses generated in each cycle t and an auxiliary ejecting pulse generated after ½ t (0.5t) is elapsed since the primary ejecting pulse is generated.

Figure 4:
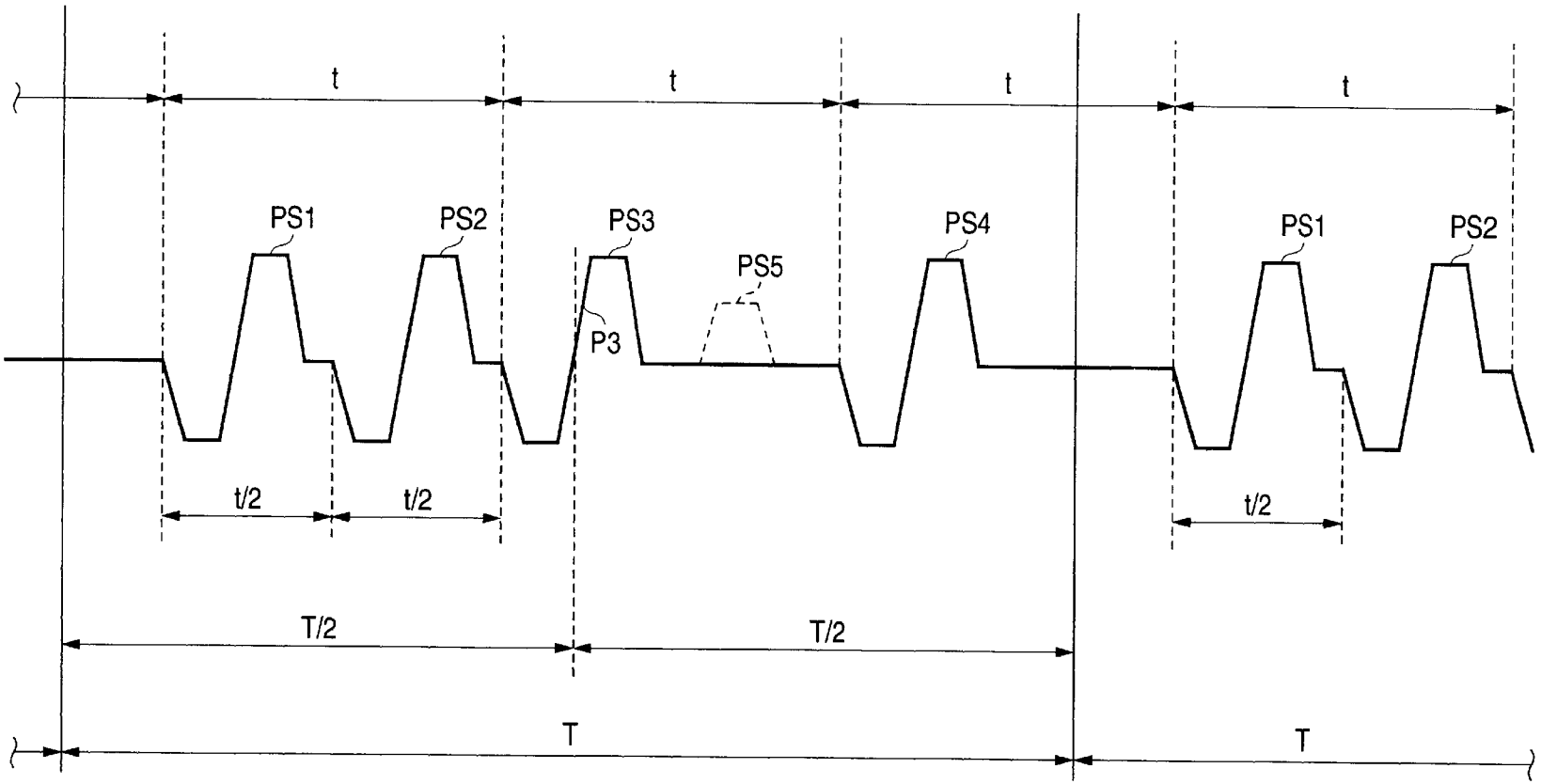
FIG. 4 is a time chart showing a drive signal according to a first embodiment of the invention.

A drive signal according to a first embodiment of the invention illustrated in FIG. 4 includes three primary ejecting pulses (a first pulse PS1, a third pulse PS3 and a fourth pulse PS4) and one auxiliary ejecting pulse (a second pulse PS2) in a unit recording period T. The drive signal generator 9 repetitively generates the drive signal in each unit recording period T. The drive signal will be described below in detail.

The print engine 2 includes the recording head 8, a carriage mechanism 12 and a paper feeding mechanism 13.

The carriage mechanism 12 includes a carriage on which the recording head 8 is mounted and a pulse motor for causing the carriage to run through a timing belt, and serves to move the recording head 8 in the main scanning direction. The paper feeding mechanism 13 includes a paper feeding motor and a paper feeding roller, and sequentially feeds recording paper (recording medium) to carry in the subscanning direction.

Figure 2:
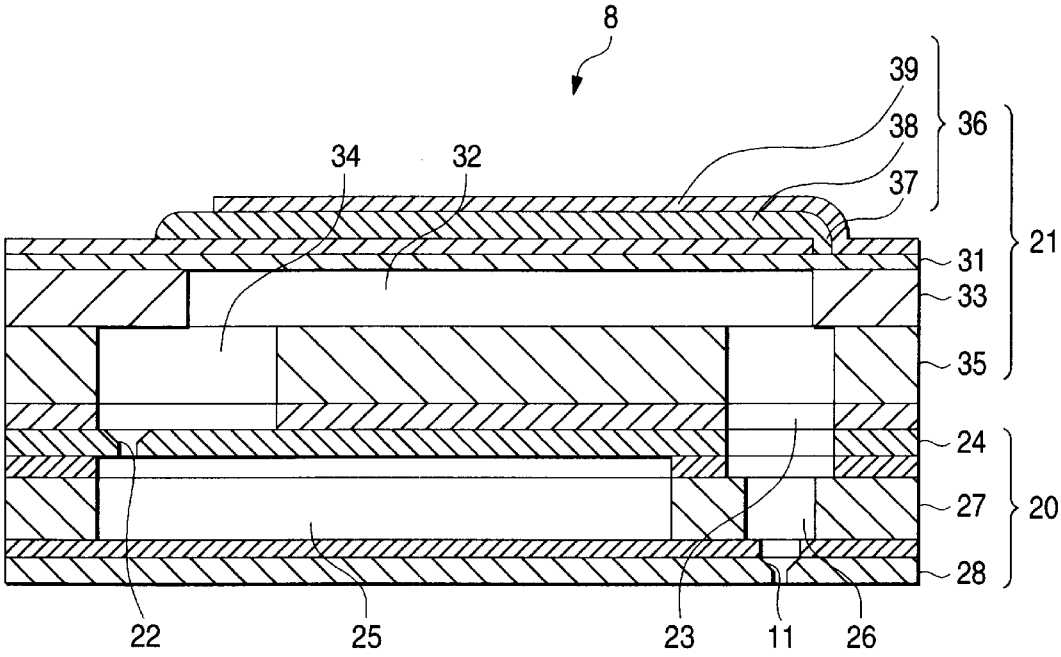
FIG. 2 is a view illustrating the mechanical structure of a recording head.

Next, the recording head 8 will be described in detail. The recording head 8 illustrated in FIG. 2 is schematically constituted by a flow channel unit 20 and an actuator unit 21.

The flow channel unit 20 is constituted by a supply port forming substrate 24 provided with a through hole to be an ink supply port 22 and a through hole to be a first nozzle communicating hole 23, a reservoir forming substrate 27 provided with a through hole to be a common ink reservoir 25 and a through hole to be a second nozzle communicating hole 26, and a nozzle plate 28 provided with a plurality of (for example, 64) nozzle orifices 11 arranged in the subscanning direction. The nozzle plate 28 is provided on the front face side (the lower side in FIG. 2) of the reservoir forming substrate 27 and the supply port forming substrate 24 are provided on the back face side (the upper side in FIG. 2) and a bonding layer is interposed between the reservoir forming substrate 27 and the nozzle plate 28 and between the reservoir forming substrate 27 and the supply port forming substrate 24, so that the supply port forming substrate 24, the reservoir forming substrate 27 and the nozzle plate 28 are provided integrally with each other.

The actuator unit 21 is constituted by a first cover member 31 to serve as an elastic plate, a pressure chamber forming substrate 33 provided with a through hole to be a pressure chamber 32, a second cover member 35 provided with a through hole for forming a supply side communicating hole 34 and a through hole for forming the first nozzle communicating hole 23, and a piezoelectric vibrator 36 to be a kind of pressure generating element according to the invention. The pressure chamber forming substrate 33 has the first cover member 31 provided on the back face and the second cover member 35 provided on the front face respectively, and the first cover member 31 and the second cover member 35 integrally interpose the pressure chamber forming substrate 33 therebetween.

The piezoelectric vibrator 36 is formed on the back face side of the first cover member 31. The illustrated piezoelectric vibrator 36 is set in a so-called flexure vibration mode. The piezoelectric vibrator 36 is constituted by a common electrode 37 formed on the first cover member 31, a piezoelectric layer 38 laminated on the common electrode 37 and a driving electrode 39 formed on the piezoelectric layer 38. A plurality of piezoelectric vibrators 36 and pressure chambers 32 are formed in association with each other.

In the recording head 8 having such a structure, a continuous ink flow channel to pass through the pressure chamber 32 from the common ink reservoir 25 and to reach the nozzle orifice 11 is formed for each nozzle orifice 11. When the piezoelectric vibrator 36 is charged or discharged, the corresponding pressure chamber 32 contracts or expands so that pressure fluctuation is occurred in the pressure chamber 32. By controlling an ink pressure in the pressure chamber 32, an ink drop can be ejected from the nozzle orifice 11.

In brief, when the piezoelectric vibrator 36 is charged, it contracts in a direction orthogonal to an electric field applied thereto so that the first cover member 31 is deformed and the pressure chamber 32 contracts with the deformation of the first cover member 31. On the other hand, when the charged piezoelectric vibrator 36 is discharged, it is extended in the direction orthogonal to the electric field so that the first cover member 31 is deformed in a return direction to cause the pressure chamber 32 to expand. When the pressure chamber 32 set in a steady state is caused to once expand and then to contract rapidly, the ink pressure in the pressure chamber 32 is raised suddenly so that the ink drop is ejected from the nozzle orifice 11. Moreover, when the pressure 32 is caused to expand and contract such that the ink drop is not ejected, meniscus of the ink slightly vibrates. Since ink is stirred in the vicinity of the nozzle orifice 11 by the slight vibration of the meniscus, the ink can be prevented from being thickened in the same portion.

Figure 3:
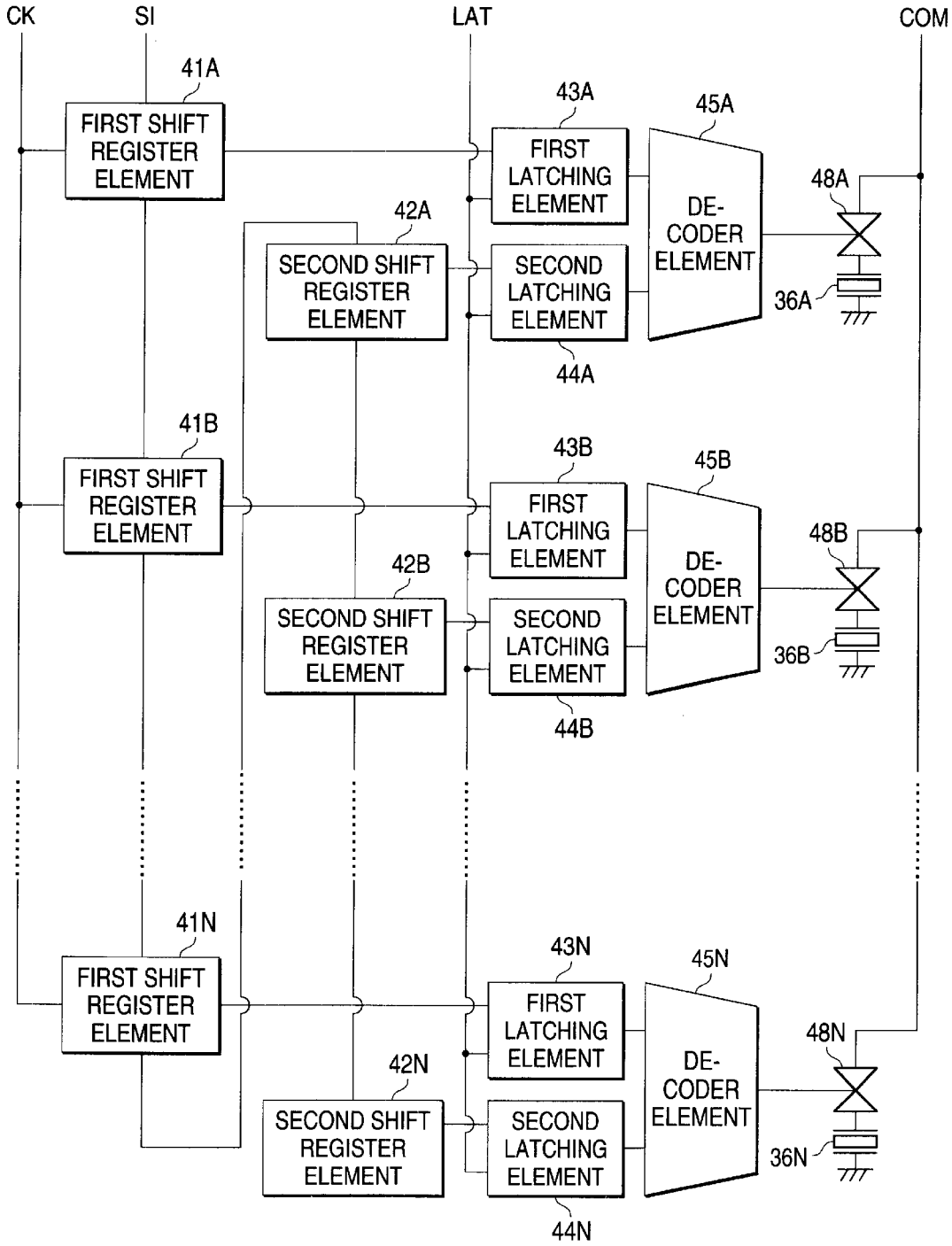
FIG. 3 is a circuit diagram showing the main part of a recording head driver.

Next, the electrical structure of the recording head 8 will be described with reference to FIGS. 1 and 3. In FIG. 3, a control logic 46 and a level shifter 47 which are shown in FIG. 1 are omitted.

The recording head 8 includes a shift register including a first shift register section 41 and a second shift register section 42, a latcher including a first latching section 43 and a second latching sections 44, a decoder 45, the control logic 46, the level shifter 47, a switcher 48 and the piezoelectric vibrator 36. The plural numbers of shift register sections 41 and 42, latching sections 43 and 44, decoders 45, switchers 48 and piezoelectric vibrators 36 are provided in association with each nozzle orifice 11 of the recording head 8, respectively. As shown in FIG. 3, for example, there are provided first shift register elements 41A to 41N, second shift register elements 42A to 42N, first latching elements 43A to 43N, second latching elements 44A and 44N, decoder elements 45A to 45N, switch elements 48A to 48N and piezoelectric vibrators 36A to 36N.

The recording head 8 ejects ink drops based on the gradation data (SI) transmitted from the printer controller 1. More specifically, the gradation data transferred from the printer controller 1 are serially transmitted from the internal I/F 10 to the first shift register section 41 and the second shift register section 42 in synchronization with the clock signal (CK) sent from the oscillator 7. The gradation data transmitted from the printer controller 1 are 2-bit data (10) or (01) as described above, and are set for each dot, that is, each nozzle orifice 11. Low order bit (bit 0) data on all the nozzle orifices 11 are inputted to the first shift register elements 41A to 41N and high order bit (bit 1) data on all the nozzle orifices 11 are inputted to the second shift register elements 42A to 42N.

The first latching section 43 is electrically connected to the first shift register second 41 and the second latching section 44 is electrically connected to the second shift register section 42. When a latch signal (LAT) is inputted from the printer controller 1 to each of the latching sections 43 and 44, the first latching section 43 latches the low order bit data of the gradation data and the second latching section 44 latches the high order bit of the gradation data. More specifically, the gradation data input to each of he shift register elements 41A to 41N and 42A to 42N are latched to the corresponding latching elements 43A to 43N and 44A to 44N. A set of the first shift register section 41 and the first latching section 43 and a set of the second shift register section 42 and the second latching section 44 which carry out such operations constitute memories respectively and temporary store the gradation data which have not been inputted to the decoder 45.

The gradation data latched in each of the latching sections 43 and 44 are inputted to the decoder 45, in detail, the decoder elements 45A to 45N. The decoder 45 translates the 2-bit gradation data and generates 4-bit print data. The decoder 45, the controller 6, the shift register sections 41 and 42 and the latching sections 43 and 44 serve as recording data generator to generate recording data from the gradation data.

Each bit of the print data corresponds to the first pulse PS1 to the fourth pulse PS4 constituting the drive signal (COM) as shown in FIG. 5, and serves as selecting information about each pulse. Moreover, the decoder 45 also inputs a timing signal from the control logic 46. The control logic 46 serves as the timing signal generator together with the controller 6 to generate a timing signal based on a latch signal (LAT) and a channel signal (CH).

The 4-bit recording data decoded by the decoder 45 are sequentially input to the level shifter 47 from the high order bit side in a timing defined by the timing signal. The level shifter 47 serves as a voltage amplifier and outputs an electric signal amplified to have a voltage capable of driving the switcher 48, for example, a voltage of approximately several tens volts if the print data are "1".

The print data of "1" amplified by the level shifter 47 are supplied to the switcher 48. The drive signal (COM) is sent from the drive signal generator 9 to the input side of the switcher 48 and the piezoelectric vibrator 36 is connected to the output side of the switcher 48. The print data control the operation of the switcher 48. For example, the drive signal is supplied to the piezoelectric vibrator 36 and the piezoelectric vibrator 36 is deformed in response to the drive signal for a period in which the print data to be applied to the switcher 48 are "1". On the other hand, the electrical signal to operate the switcher 48 is not output from the level shifter 47 for period in which the print data to be applied to the switcher 48 are "0". Therefore, the drive signal is not supplied to the piezoelectric vibrator 36. In brief, the first pulse PS1 to the fourth pulse PS4 to which the print data of "1" are set are selectively supplied to the piezoelectric vibrator 36.

As is apparent from the above description, in the embodiment, the controller 6, the shift register sections 41 and 42, the latching sections 43 and 44, the decoder 45, the control logic 46, the level shifter 47 and the switcher 48 serve as a pulse supplier according to the invention, so that the first pulse PS1 to the fourth pulse PS4 to be ejecting pulses are selectively supplied from the drive signal to the piezoelectric vibrator 36.

Next, description will be given to the drive signal (COM) and ink discharge control based on the drive signal.

First of all, the drive signal will be described. As shown in FIG. 4, the drive signal generated by the drive signal generator 9 is constituted to include primary ejecting pulses generated every cycle t (for example, 50 microseconds) and an auxiliary ejecting pulse generated after ½ t (for example, 25 microseconds) is elapsed since the primary ejecting pulse is generated. In other words, the drive signal is a serial signal including the primary ejecting pulses and the auxiliary ejecting pulse which have the same waveform so that the primary ejecting pulse is generated every cycle t and the auxiliary ejecting pulse is generated after 1.5t (for example, 75 microseconds) is elapsed since a cooperated primary ejecting pulse is generated.

The drive signal generator 9 according to the embodiment generates the first pulse PS1, the third pulse PS3 and the fourth pulse PS4 for each cycle t as the primary ejecting pulses. The third pulse PS3 to be the second primary ejecting pulse is generated in a timing which is almost half of the recording period T. More specifically, the third pulse PS3 is generated such that an ejecting element P3 (see FIG. 5) which will be described below is provided at a timing of ½ T.

Moreover, the drive signal generator 9 generates the second pulse PS2 to be the auxiliary ejecting pulse in a timing which is just the middle of the first pulse PS1 and the third pulse PS3. In other words, the second pulse PS2 is generated in such a timing that ½ t is elapsed since the first pulse PS1 to be the first primary ejecting pulse is generated.

All the first pulse PS1 to the fourth pulse PS4 are constituted by ejecting pulses having the same waveform. More specifically, as shown in FIG. 5, the first pulse PS1 to the fourth pulse PS4 are constituted to include an expanding element P1 for dropping a voltage with such a constant gradient that the ink drop is not ejected from an intermediate voltage VM to the lowest voltage VL, an expansion holding element P2 for holding the lowest voltage VL for a predetermined time, an ejecting element P3 for raising the voltage with a steep gradient from the lowest voltage VL to the highest voltage VP, a contraction holding element P4 for holding the highest voltage VP for a predetermined time and a damping element P5 for dropping the voltage from the highest voltage VP to the intermediate voltage VM.

When the first pulse PS1 to the fourth pulse PS4 are supplied to the piezoelectric vibrator 36, a predetermined amount (for example, 13 picoliters) of small ink drops are ejected from the nozzle orifice 11 every time each of the pulses PS1 to PS4 is supplied. Accordingly, the size of a dot to be recorded can be varied by changing the number of the ejecting pulses to be supplied in a unit recording period T.

For this reason, the pulse supplier (the controller 6, the shift register sections 41 and 42, the latching sections 43 and 44, the decoder 45, the control logic 46, the level shifter 47 and the switcher 48 and so on) can vary the number of the selected ejecting pulses (the first pulse PS1 to the fourth pulse PS4) in a unit recording period T depending on the size of the dot to be recorded. In other words, the pulse supplier can vary the number of the selected ejecting pulses in the recording period T depending on a gradation level to be recorded.

In the embodiment, as shown in FIG. 5, the ejecting pulse is not supplied to the piezoelectric vibrator 36 in the case of the gradation level 1 (gradation data 00). In the case of the gradation level 2 (gradation data 01), one ejecting pulse is supplied to the piezoelectric vibrator 36 in the recording period T to record a small dot. In the case of the gradation level 3 (gradation data 10), two ejecting pulses are supplied to the piezoelectric vibrator 36 in the recording period T to record a medium dot. In the case of the gradation level 4 (gradation data 11), three ejecting pulses are supplied to the piezoelectric vibrator 36 in the recording period T to record a large dot.

For this reason, the decoder 45 generates 4-bit print data (D1, D2, D3, D4) by decoding the gradation data, and outputs data on each of the bits D1 to D4 constituting the recording data in synchronization with a timing signal sent from the control logic 46.

The bit D1 constituting the recording data is data responding to the first pulse PS1 and the bit D2 is data corresponding to the second pulse PS2. Moreover, the bit D3 constituting the recording data is data corresponding to the third pulse PS3 and the bit D4 is data corresponding to the fourth pulse PS4. The decoder 45 outputs the data on the bit D1 to the level shifter 47 in the timing of a latch signal, and outputs the data on the bit D2 to the level shifter 47 In the timing of a first channel signal CH1. Similarly, the decoder 45 outputs the data on the bit D3 to the level shifter 47 in the timing of a second channel signal CH2, and outputs the data on the bit D4 to the level shifter 47 in the timing of a third channel signal CH3.

In this case, when successively recording dots having the same size, the pulse supplier selectively supplies the primary electing pulse and the auxiliary ejecting pulse to the piezoelectric vibrator 36 such that the interval at which the pulse is to be supplied to the piezoelectric vibrator 36 is constant over the adjacent unit recording periods T. In other words, the interval at which the ejecting pulse is to be supplied is set to be constant for each gradation level.

Figure 7:
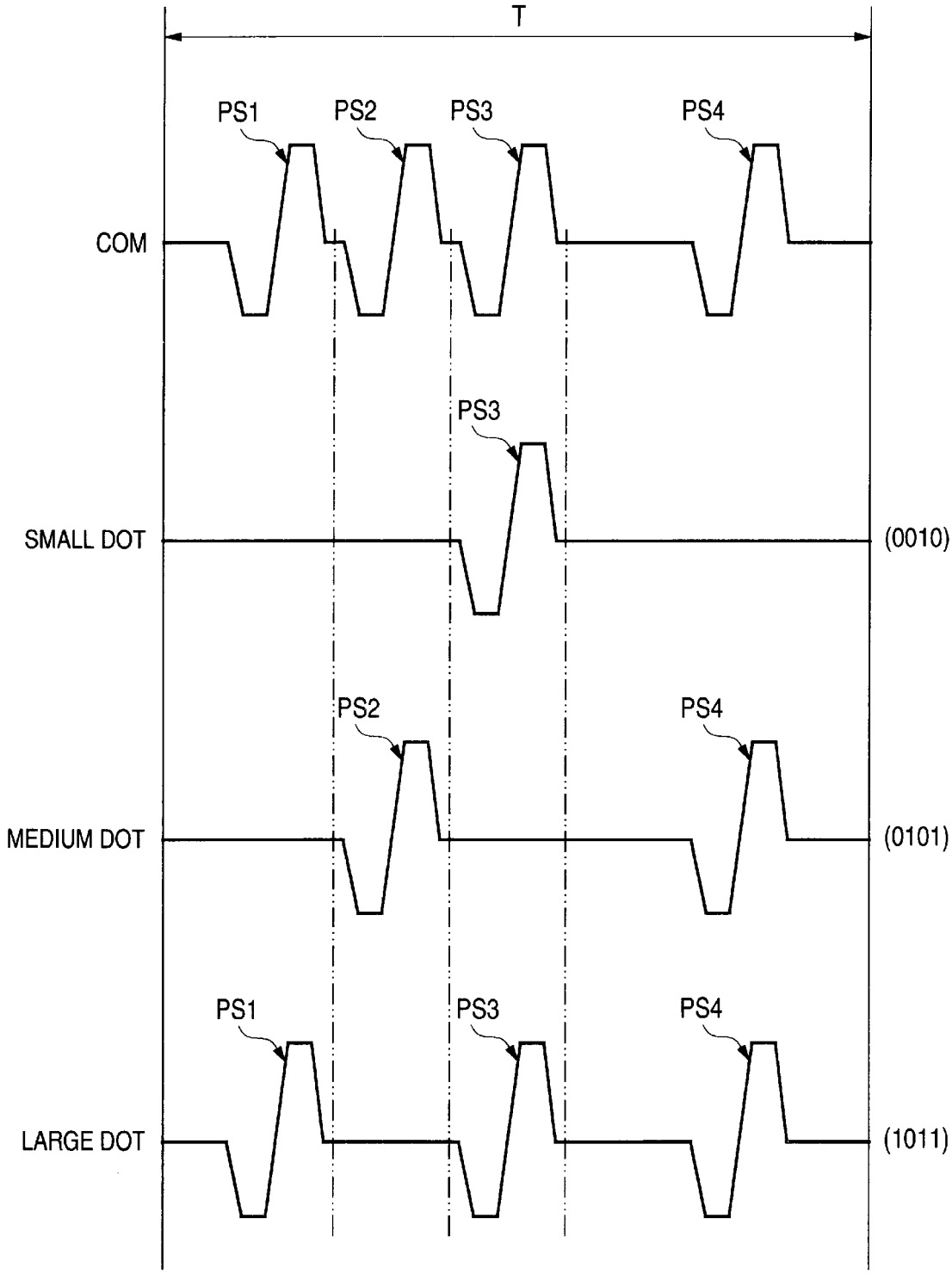
FIG. 7 is a time chart showing selected patterns of the drive pulses in a unit recording period.

For example, in the case of the gradation level 2 (small dot recording), the decoder 45 generates recording data (0010) by decoding the gradation data (01) and sequentially outputs the data on each of the bits D1 to D4 in synchronization with the timing signal sent from the control logic 46. As shown in FIG. 7, consequently, only the third pulse PS3 (specific primary ejecting pulse) in the drive signals is selectively supplied to the piezoelectric vibrator 36. Thus, a small ink drop corresponding to the third pulse PS3 is ejected and a small dot is recorded on the recording paper.

Figure 8:
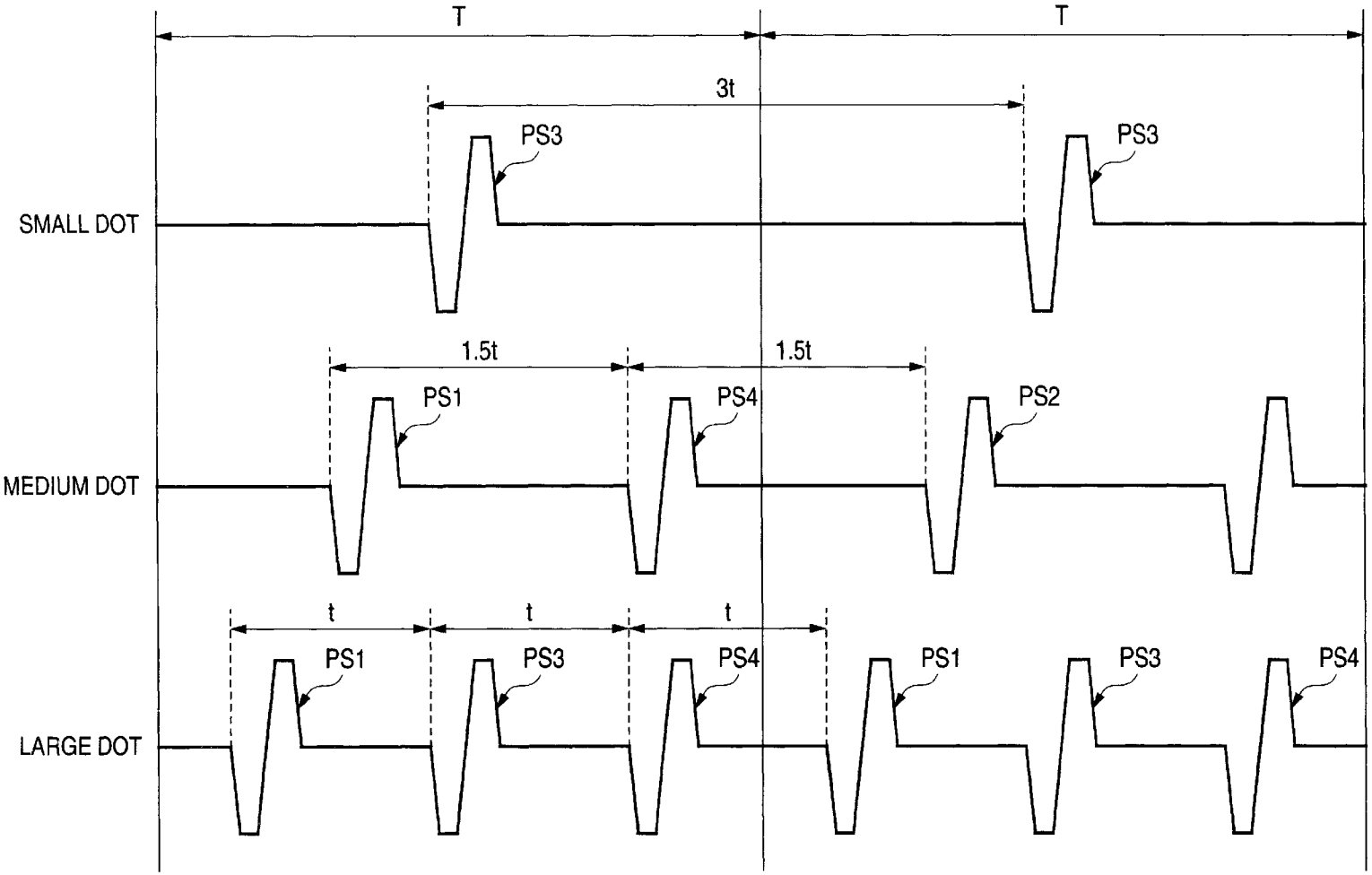
FIG. 8 is a time chart showing the selected patterns of the drive pulses in adjacent unit recording periods.

At this time, as shown in FIG. 8, the interval at which the ejecting pulse is to be supplied is a time interval from the third pulse PS3 in a previous unit recording period T to the third pulse PS3 in a subsequent unit recording period T. A time interval between the third pulses PS3 in adjacent unit recording periods is 3t because the first pulse PS1 in the same unit recording period T and the fourth pulse PS4 for the previous unit recording period T are provided therebetween, or because the fourth pulse PS4 in the same unit recording period T and the first pulse PS1 for the subsequent unit recording period T are provided therebetween.

In this case, accordingly, the ejecting pulse is supplied to the piezoelectric vibrator 36 every cycle 3t (for example, 150 microseconds).

In the case of the gradation level 3 (medium dot recording), the decoder 45 generates recording data (0101) by decoding the gradation data (10) and sequentially outputs the data on each of the bits D1 to D4 in synchronization with the timing signal sent from the control logic 46. As shown In FIG. 7, consequently, the second pulse PS2 and the fourth pulse PS4 in the drive signals are selectively supplied to the piezoelectric vibrator 36. Thus, a small ink drop corresponding to the second pulse PS2 and the fourth pulse PS4 is ejected twice so that a medium dot is recorded on the recording paper.

In this case, as shown in FIG. 8, a time interval from the second pulse PS2 to the fourth pulse PS4 which belong to the same unit recording period T is 1.5t by adding both a time interval from the second pulse PS2 to the third pulse PS3 of 0.5t and the predetermined cycle t from the third pulse PS3 to the fourth pulse PS4. Similarly, a time interval from the fourth pulse PS4 belonging to a previous unit recording period T to the second pulse PS2 belonging to a subsequent unit recording period T is 1.5t because a time interval from the fourth pulse PS4 belonging to the previous unit recording period T to the subsequent unit recording period T is the predetermined cycle t and a time interval from the first pulse PS1 to the second pulse PS2 is 0.5t.

In this case, accordingly, the ejecting pulse is supplied to the piezoelectric vibrator 36 every cycle 1.5t (for example, 75 microseconds).

In the case of the gradation level 4 (large dot recording), the decoder 45 generates recording data (1011) by decoding the gradation data (11) and sequentially outputs the data on each of the bits D1 to D4 in synchronization with the timing signal sent from the control logic 46. As shown in FIG. 7, consequently, the first pulse PS1, the third pulse PS3 and the fourth pulse PS4 in the drive signals are selectively supplied to the piezoelectric vibrator 36. Thus, a small ink drop corresponding to the first pulse PS1, the third pulse PS3 and the fourth pulse PS4 is ejected three times so that a large dot is recorded on the recording paper.

At this time, as shown in FIG. 8, all the primary ejecting pulses generated every predetermined cycle t are selected. Therefore, a time interval from a final ejecting pulse (the fourth pulse PS4) in a previous unit recording period T to a first ejecting pulse (the first pulse PS1) in a subsequent unit recording period T is also the predetermined cycle t.

In this case, accordingly, the ejecting pulse is supplied to the piezoelectric vibrator 36 every cycle t (for example, 50 microseconds).

In the case of the gradation level 1 (no recording), the decoder 45 generates 4-bit recording data (0000) by decoding the gradation data (00) and sequentially outputs the data on each of the bits D1 to D4 in synchronization with the timing signal sent from the control logic 46. In this case, the ejecting pulse is not supplied to the piezoelectric vibrator 36. Therefore, a dot is not recorded on the recording paper.

As a result that the interval at which the ejecting pulse is to be supplied is set to be constant for each gradation, the state of a meniscus at a time when the first pulse PS1 to the fourth pulse PS4 are started to be supplied, for example, a direction of vibration, a speed and a position of the meniscus of ink can be set to be equal.

Figure 9A:
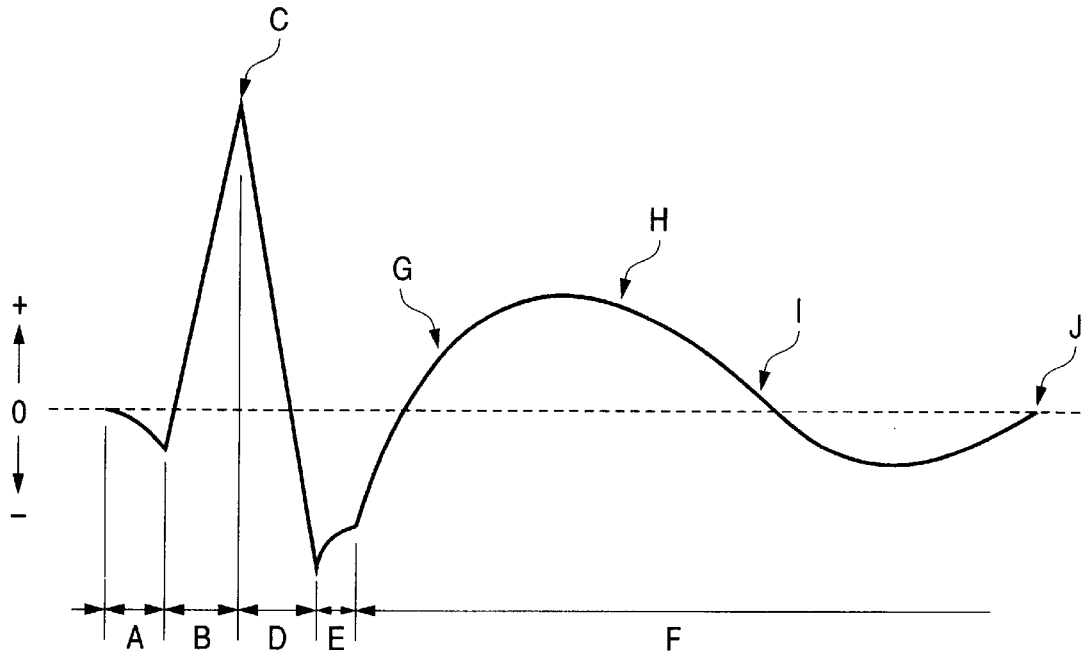
FIG. 9A is a chart illustrating a change in a state of meniscus of ink when an ink drop is ejected.
Figure 9B:
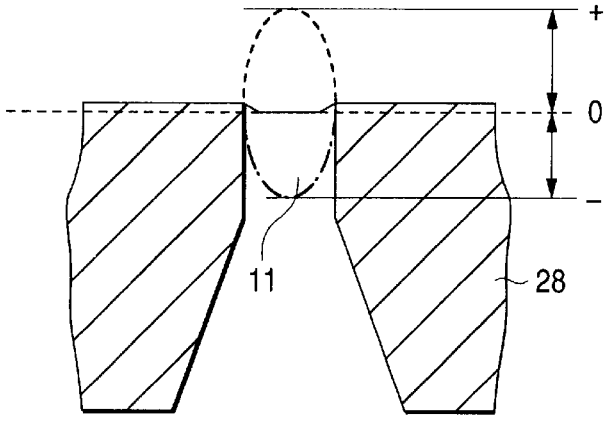
FIG. 9B is a diagram showing a state of the meniscus in the vicinity of a nozzle orifice.

The foregoing will be described with reference to FIGS. 9A and 9B. In FIG. 9A, "0" indicates the steady state of the meniscus of ink, that is, a state in which the meniscus of ink is stationary on the opening edge of the nozzle orifice 11. Moreover, "+" indicates a state in which the meniscus of ink is bulged outward (the recording paper side) from a nozzle formation face as shown in a dashed line in FIG. 9B and the meniscus is bulged more greatly with an increase toward the "+" side. To the contrary, "−" indicates a state in which the meniscus is concaved inwardly (the pressure chamber 32 side) from the nozzle formation face as shown in a chain line in FIG. 9B and the meniscus is concaved more greatly with an increase toward the "−" side.

In the example of FIG. 9A the meniscus in the steady state is first slightly concaved inwardly with a pressure reduction of the pressure chamber 32 through the supply of the expanding element P1 (period A). Subsequently, the meniscus is greatly bulged outward with a rapid pressurization of the pressure chamber 32 through the supply of the ejecting element P3 (period B) and an ink drop is ejected in a timing indicated as C. With the discharge of the ink drop, the meniscus is rapidly concaved greatly inwardly by reaction thereof (period D). Then, the pressure chamber 32 is expanded through the supply of the damping element P5 to relieve the rapid movement of the meniscus (period E). Then, the supply of the ejecting pulse is stopped so that the meniscus freely vibrates in a natural vibration cycle Tc of the ink in the pressure chamber 32 (period F). Thus, a subsequent ejecting pulse is supplied for the period F.

In a case where the small dot is to be recorded successively, the third pulse PS3 is supplied to the piezoelectric vibrator 36 every cycle 3t. For this reason, a timing in which a previous ejecting pulse is supplied to the piezoelectric vibrator 36 and a subsequent ejecting pulse is then supplied is constant as shown in I of FIG. 9A, for example. Accordingly, the state (position, moving direction and moving speed, for example) of the meniscus of ink when the subsequent ejecting pulse is supplied can be matched with the previous one.

Thus, since the state of the meniscus of ink, that is, the state of the previous chamber 32 in every ink ejection can be made equal, it is possible to avoid variation in the amount, the flight speed or direction of the ink drop, thereby enhancing the recorded image quality.

In the embodiment, the third pulse PS3 (the second primary ejecting pulse) for recording the small dot is generated in a timing which is half of the recording period T. Therefore, the center of impact of the small dot is almost the middle of a main scanning direction in a dot recording region to be a region that an ink drop constituting one dot can impact. Consequently, the deviation of a dot recording position can be lessened and the recorded image quality can be enhanced.

In a case where the medium dot is to be recorded successively, moreover, the second pulse PS2 and the fourth pulse PS4 are alternately supplied to the piezoelectric vibrator 36 every cycle 1.5t For this reason, a timing in which a previous ejecting pulse is supplied to the piezoelectric vibrator 36 and a subsequent ejecting pulse is then supplied is constant as shown in H of FIG. 9A, for example. Accordingly, the state of the meniscus when the subsequent ejecting pulse is supplied can be matched with the previous one.

Also when recording the medium dot, consequently, it is possible to avoid variation in the flight speed and the flight direction of the ink drop, thereby enhancing the recorded image quality.

If the interval at which the ejecting pulse is supplied is varied as in the related example as discussed before, the timing in which the ejecting pulse is supplied is varied as shown in G and I, for example. In this case, the state of the meniscus when the ejecting pulse is supplied is varied from the previous one. Therefore, the flight speed and the flight direction of the ink drop cannot be matched.

In the embodiment, the second pulse PS2 (the auxiliary ejecting pulse) and the fourth pulse PS4 (the third primary ejecting pulse) are selected as the ejecting pulse for recording the medium dot. The second pulse PS2 and the fourth pulse PS4 are generated before and after the third pulse PS3 (the second primary ejecting pulse) to be selected when recording the small dot. More specifically, the second pulse PS2 is generated before the third pulse PS3 and the fourth pulse PS4 is generated after the third pulse PS3.

Thus, when the medium dot is recorded by a pair of the second and fourth pulses PS2 and PS4 generated before and after the third pulse PS3 to be selected when recording the small dot, two ink drops constituting the medium dot impact on both sides of the ink drop constituting the small dot in a case where the small dot and the medium dot are to be overlapped in the same dot recording region. As a result, the deviation of the dot recording position can be lessened. Also in this respect, the recorded image quality can be enhanced.

In a case where the large dot is to be recorded successively, moreover, the first pulse PS1, the third pulse PS3 and the fourth pulse PS4 are alternately supplied to the piezoelectric vibrator 36 every cycle t. For this reason, a timing in which a previous ejecting pulse is supplied to the piezoelectric vibrator 36 and a subsequent ejecting pulse is then supplied is constant as shown in G of FIG. 9A, for example. Accordingly, the state of the meniscus when the subsequent ejecting pulse is supplied can be matched with the previous one.

Also when recording the large dot, consequently, it is possible to prevent a variation in the flight speed and the flight direction of the ink drop, thereby enhancing the recorded image quality.

In the embodiment, the third pulse PS3 (the second primary ejecting pulse) corresponding to an ink drop to impact on the center in the main scanning direction in three ink drops constituting the large dot is generated in a timing which is half of the recording period T. Therefore, the center of impact of the large dot is almost the middle of a main scanning direction in a dot recording region. Consequently, the deviation of a dot recording position can be lessened and the recorded image quality can be enhanced.

The invention is not restricted to the embodiment described above and changes and modifications as are obvious are deemed to come within the spirit, scope and contemplation of the invention as defined in the appended claims.

For example, the drive signal generated from the drive signal generator 9 may include a vibrating pulse for slightly vibrating meniscus of ink such an extent that an ink drop is not ejected, and the pulse supplier may select the vibrating pulse to be supplied to the pressure generating element in a case where the gradation level 1 (no recording) is set. With such a structure, the drive signal generator 9 generates the vibrating pulse in such a timing as not to overlap with the second pulse PS2 to be the auxiliary ejecting pulse. More specifically, a vibrating pulse PS5 is generated in a timing between the third pulse PS3 and the fourth pulse PS4 as shown in a dashed is line of FIG. 4.

With such a structure, the vibrating pulse PS5 is supplied to the piezoelectric vibrator 36 corresponding to the nozzle orifice 11 which does not eject ink drops. As a result, ink in the nozzle orifice 11 is stirred by the slight vibration of the meniscus and is thereby mixed with ink in the pressure chamber 32. Therefore, it is possible to prevent an ink viscosity from being increased due to evaporation of ink solvent.

Moreover, while the drive signal including three primary ejecting pulses and one auxiliary ejecting pulse in the unit recording period T has been illustrated In the embodiment, the drive signal is not restricted to the waveform.

For example, the second pulse PS2 to be Me auxiliary ejecting pulse may be generated between the third pulse PS3 to be the second primary ejecting pulse and the fourth pulse PS4 to be the third primary ejecting pulse. More specifically, the second pulse PS2 is generated after ½ t is elapsed since the third pulse PS3 is generated. In this case, the medium dot is recorded by supplying the first pulse PS1 (the first primary ejecting pulse) and the second pulse PS2 to the piezoelectric vibrator 36. With such a structure, similarly, the same function and effect as those in the embodiment can be obtained.

Moreover, the number of the primary ejecting pulses to be generated in the recording period T is not restricted to three but may be three or more. Similarly, a plurality of auxiliary ejecting pulses may be generated in the recording period T.

Figure 10:
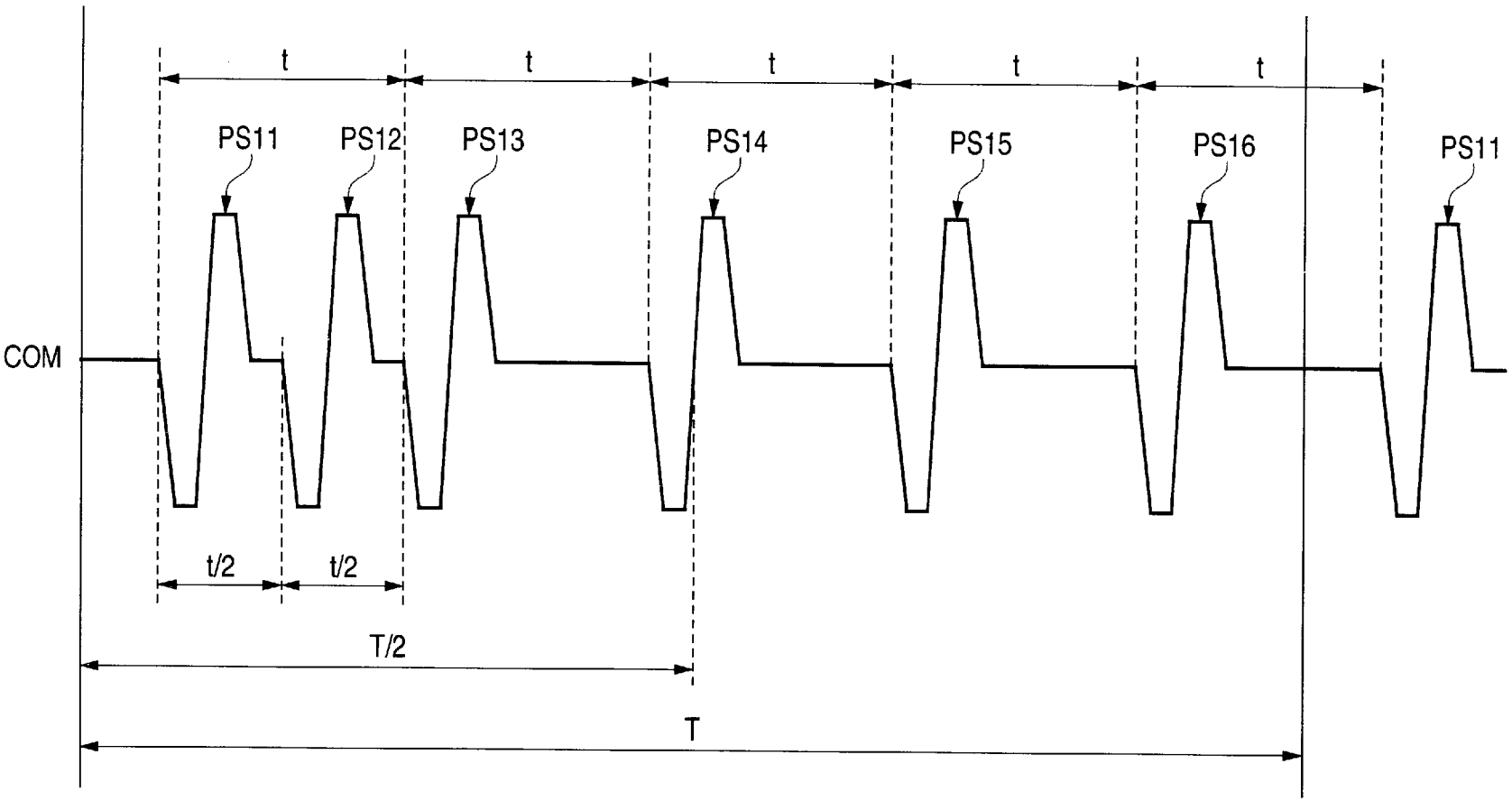
FIG. 10 is a time chart showing a drive signal according to a second embodiment of the invention.

FIG. 10 shows such an example which is a second embodiment of the invention. The drive signal may be constituted including five primary ejecting pulses (pulse signals PS11, PS13, PS14, PS15, PS16) and one auxiliary ejecting pulse (a pulse signal PS12). In this case, the medium dot is recorded by two ink drops and the pulse signal PS12 to be the auxiliary ejecting pulse is generated between the pulse signal PS11 to be the first primary ejecting pulse and the pulse signal PS13 to be the second primary ejecting pulse. In a case where the medium dot is to be recorded, the pulse signal PS12 and the pulse signal PS15 to be the fourth primary ejecting pulse are supplied to the piezoelectric vibrator 36.

Figure 11:
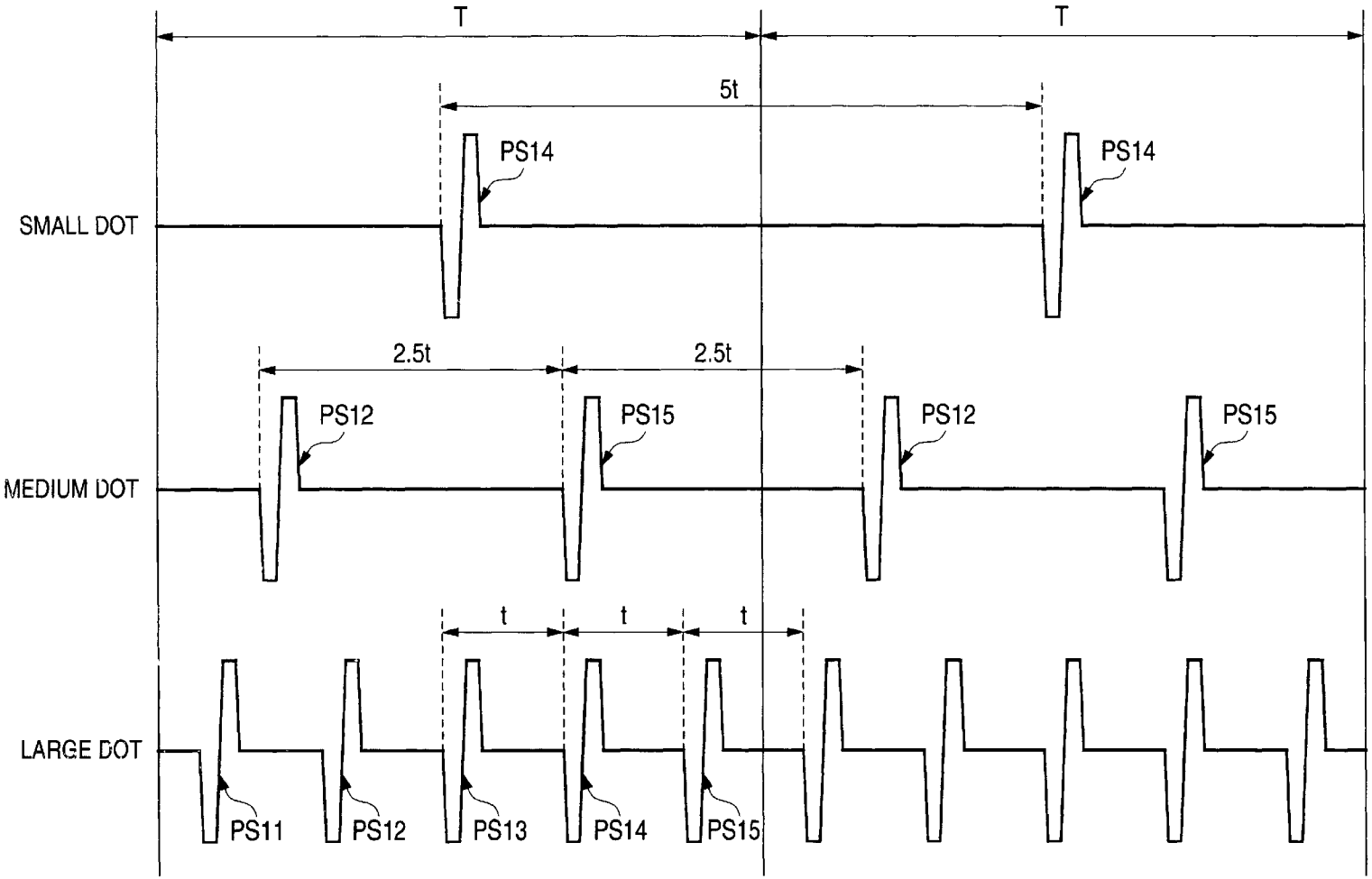
FIG. 11 is a time chart showing selected patterns of drive pulses according to the second embodiment.

As shown in FIG. 11, consequently, the time interval between the ejecting pulses is set to be constant with 5t when the small dot is to be recorded successively. The time interval between the ejecting pulses is set to be constant with 2.5t when the medium dot is to be recorded successively. The time interval between the ejecting pulses is set to be constant with t when the large dot is to be recorded successively.

As a result, in each gradation level, the state of the meniscus when each ejecting pulse is started to be supplied can be made equal. Thus, it is possible to avoid variation in the amount the flight speed and the flight direction of the ink drop, thereby enhancing the recorded image quality.

Figure 12:
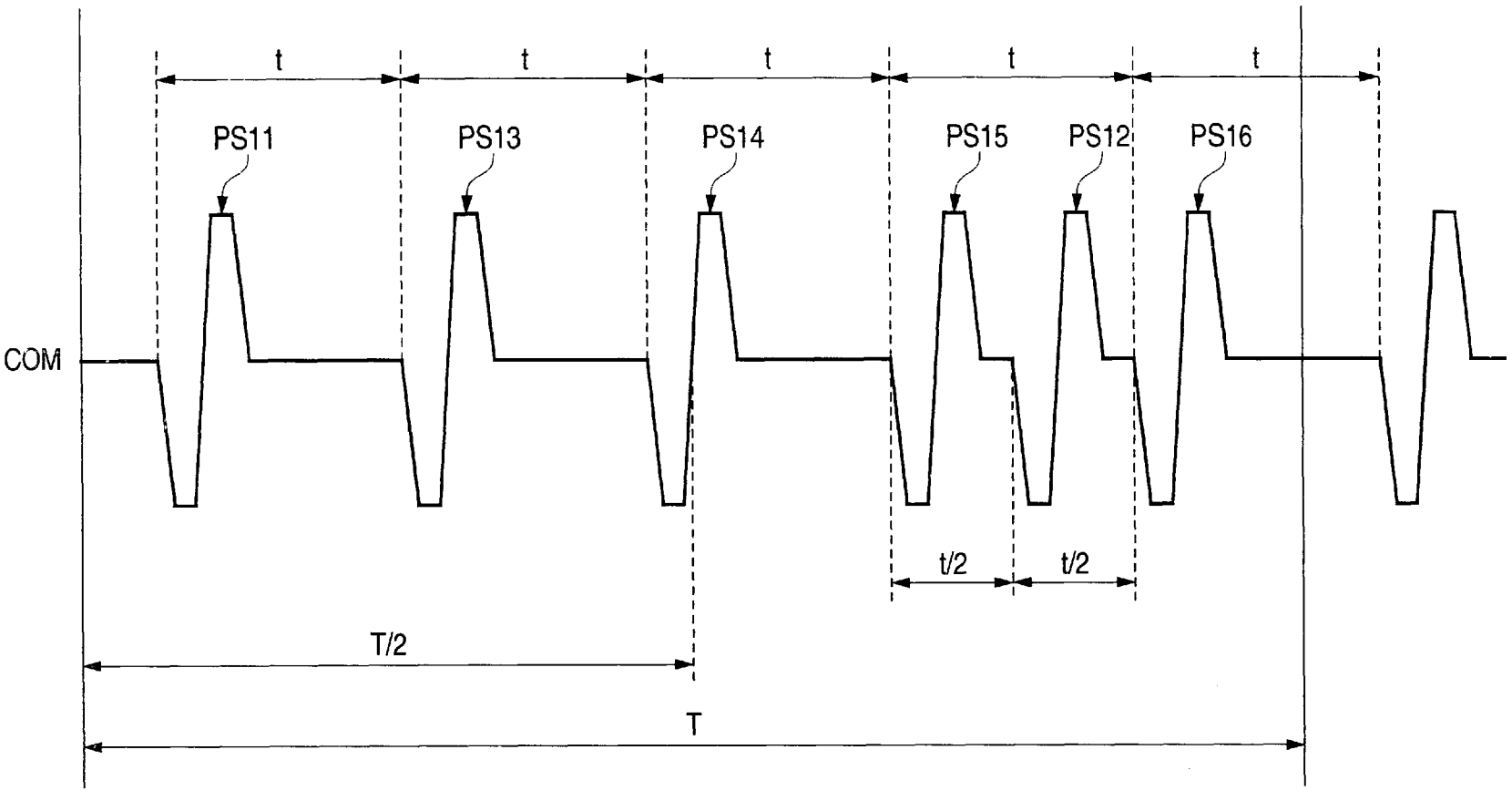
FIG. 12 is a time chart showing a drive signal according to a modification of the second embodiment.

As shown in FIG. 12, even if the pulse signal PS12 to be the auxiliary ejecting pulse is generated between the pulse signal PS15 to be the fourth primary ejecting pulse and the pulse signal PS16 to be the fifth primary ejecting pulse, the same function and effect as those described above can be obtained.

Moreover, while the gradation data are converted into the recording data through the decoder 45 in the embodiment, a controller including a CPU may be used in place of the decoder 45.

Furthermore, while the piezoelectric vibrator 36 in a so-called flexure vibration mode has been used for the pressure generating element a piezoelectric vibrator in a longitudinal vibration mode may be used instead. The piezoelectric vibrator in the longitudinal vibration mode is contacted in such a direction as to expand the pressure chamber 32 when it is charged, and extended in such a direction as to contract the pressure chamber 32 when it is discharged. Moreover, the pressure generating element for changing the volume of the pressure chamber 32 is not restricted to the piezoelectric vibrator. For example, a magnetostrictive element may be used for the pressure generating element.

Moreover, a heat generating element such as a heater may be used for the pressure generating element and the volume of a bubble generated by the heat of the heat generating element may be changed, thereby causing pressure fluctuation in a pressure chamber.

What is claimed is:

1. An ink jet recording apparatus, comprising:

an ink jet recording head, including a nozzle orifice, a pressure chamber communicated with the nozzle orifice, and a pressure generating element which generates pressure fluctuation in ink stored in the pressure chamber to elect an ink drop from the nozzle orifice;

a drive signal generator, which generates a series of drive signals, each drive signal including at least three primary ejecting pulses generated at a first cycle in a unit recording period and at least one auxiliary ejecting pulse generated after a time period which is a half of the first cycle is elapsed since one of the primary ejecting pulse is generated, the primary ejecting pulses and the auxiliary ejecting pulse having an identical waveform; and a pulse supplier, which selectively applies at least one of the primary ejecting pulses and the auxiliary pulse from the drive signal to the pressure generating element so that the number of ink drops ejected in the unit recording period is changed in accordance with a size of dot to be recorded, the pulse supplier selecting supplied pulse such that time intervals of the supplied pulses are made constant over adjacent unit recording periods when dots having the same size are successively recorded.

2. The recording apparatus as set forth in claim 1, wherein three primary ejecting pulses and an auxiliary ejecting pulse are included in each drive signal;

wherein the pulse supplier selects the three primary ejecting pulses from the drive signal when a dot having a first size is recorded; and wherein the pulse supplier selects one of the primary ejecting pulses and the auxiliary ejecting pulse from the drive signal when a dot having a second size which is smaller than the first size is recorded.

3. The recording apparatus as set forth in claim 2, wherein the pulse supplier selects one of the primary ejecting pulses which is secondary generated when a dot having a third size which is smaller than the second size is recorded; and wherein the primary ejecting pulse selected when the second size of dot is recorded is a primary ejecting pulse placed in opposite side of the secondary generated primary ejecting pulse with respect to the auxiliary ejecting pulse.

4. The recording apparatus as set forth in claim 2, wherein a timing which is a half of the unit recording period comes while a primary ejecting pulse appeared secondary is generated.

5. The recording apparatus as set forth in claim 1, wherein the drive signal includes a vibrating pulse which is selectively applied to the pressure generating element by the pulse supplier for vibrating meniscus of ink in the nozzle orifice such an extent that an ink drop is not ejected therefrom; and wherein the vibrating pulse is generated between at least one pair of the adjacent primary ejecting pulses at which no auxiliary ejecting pulse is generated.

6. The recording apparatus as set forth in claim 1, wherein the pressure generating element is a piezoelectric vibrator which varies a volume of the pressure chamber.

7. The recording apparatus as set forth in claim 1, wherein the pressure generating chamber is a heating element which varies a volume of an air bubble gated in ink stored in the pressure chamber with heat.

8. A method of driving an ink jet recording apparatus provided with an ink jet recording head, including a nozzle orifice, a pressure chamber communicated with the nozzle orifice, and a pressure generating element the method comprising the steps of:

generating a series of drive signals, each drive signal including at least three primary ejecting pulses generated at a first cycle in a unit recording period and at least one auxiliary ejecting pulse generated after a time period which is a half of the first cycle is elapsed since one of the primary ejecting pulse is generated, the primary ejecting pulses and the auxiliary ejecting pulse having an identical waveform;

selecting at least one of the primary ejecting pulses and the auxiliary pulse from the drive signal such that the number of ink drops ejected in the unit recording period is changed in accordance with a size of dot to be recorded, and such that time intervals of the supplied pulses are made constant over adjacent unit recording periods with respect to all recordable gradation levels; and applying the selected ejecting pulse to the pressure generating element to generate pressure fluctuation in ink stored in the pressure chamber to eject an ink drop from the nozzle orifice.

9. The driving method as set forth in claim 8, wherein three primary ejecting pulses and an auxiliary ejecting pulse are included in each drive signal so that a first gradation level realized by a dot having a first size, a second gradation level realized by a dot having a second size which is smaller than the first size, and a third gradation level realized by a dot having a third size which is smaller than the second size are made recordable;

wherein the three primary ejecting pulses are selected from the drive signal when the first gradation level is recorded;

wherein one of the primary ejecting pulses and the auxiliary ejecting pulse are selected from the drive signal when the second gradation level is recorded; and wherein one of the primary ejecting pulses is selected from the drive signal when the third gradation level is recorded.

10. The driving method as set forth in claim 9, wherein the primary ejecting pulse selected when the third gradation level is recorded is a primary ejecting pulses which is secondary generated; and wherein the primary ejecting pulse selected when the second gradation level is recorded is a primary ejecting pulse placed in opposite side of the secondary generated primary ejecting pulse with respect to the auxiliary ejecting pulse.

11. The driving method as set forth in claim 8, wherein the pressure fluctuation is generated by varying a volume of the pressure chamber through use of a piezoelectric vibrator as the pressure generating element.

12. The driving method as set forth in claim 8, wherein the pressure fluctuation is generated by varying a volume of an air bubble generated in ink stored in the pressure chamber with heat generated from a heating element provided as the pressure generating element.

* * * * *